US005857675A

United States Patent [19]

Hertel

[11] Patent Number: 5,857,675

[45] Date of Patent: Jan. 12, 1999

[54] EDUCATIONAL DINOSAUR BOARD GAME

[76] Inventor: Amy Lily Hertel, 7822 Mallen Dr., Charlotte, N.C. 28212

[21] Appl. No.: 834,950

[22] Filed: Apr. 7, 1997

[51] Int. Cl.[6] ..... A63F 3/00

[52] U.S. Cl. ..... 273/254

[58] Field of Search ..... 273/240, 242, 273/243, 254

[56] References Cited

U.S. PATENT DOCUMENTS

| | | | |
|---|---|---|---|
| 5,303,928 | 4/1994 | Scuderi | 273/254 X |
| 5,443,629 | 8/1995 | Saville et al. | 273/240 X |
| 5,547,198 | 8/1996 | Kaiser | 273/240 X |

*Primary Examiner*—William E. Stoll

[57] ABSTRACT

This new board game will give children the opportunity to study facts and figures about dinosaurs. In order to play this game, children must answer questions about dinosaurs, pronounce dinosaur names, spell and define dinosaur words accurately in order to gain bonus points, which are called Energy Bars. Energy bars help keep the children out of the tarpit. One square requests that a player draw a dinosaur. Instructions for drawing dinosaurs are part of the game. Another square sends a child to China to be in charge of a dig—which causes the player to lose a turn because of travel time and responsibilities. Another square makes a child become the curator of Amy's Museum of Killer Death Lizards—which, again, causes the player to lose a turn because of meetings and responsibilities. The player that goes around the board seven times, which then gives the player 14 chances to answer questions, define and spell words, pronounce names, and draw a dinosaur, becomes the winner. If there is a tie, the child with the most energy bars is declared the winner. If there is still a tie, the child with the best-drawn dinosaur wins.

2 Claims, 15 Drawing Sheets

FIG 3

Name_____

Scorecard

| | Pronounce | Spell | Define | Answer |
|---|---|---|---|---|
| Round 1 | yes no | yes no | yes no | yes no |
| | yes no | yes no | yes no | yes no |
| Round 2 | yes no | yes no | yes no | yes no |
| | yes no | yes no | yes no | yes no |
| Round 3 | yes no | yes no | yes no | yes no |
| | yes no | yes no | yes no | yes no |
| Round 4 | yes no | yes no | yes no | yes no |
| | yes no | yes no | yes no | yes no |
| Round 5 | yes no | yes no | yes no | yes no |
| | yes no | yes no | yes no | yes no |
| Round 6 | yes no | yes no | yes no | yes no |
| | yes no | yes no | yes no | yes no |
| Round 7 | yes no | yes no | yes no | yes no |
| | yes no | yes no | yes no | yes no |

ALL THAT DINO JAZZ™

©1996 AMY HERTEL

Contents:

- Markers - 6
  - 3 Herbivore Dinosaurs
  - 3 Carnivore Dinosaurs
- Cards - 4 sets with 42 cards
  - Spelling Cards
  - Pronounciation Cards
  - Question Cards
  - Definition Cards
- Dice - 6 sets of 4 die
  - Pick Ax
  - Shovel
  - Brush
  - Bone
  - Rib Bone
  - Claw
- Game Board
- Energy Bars
- Scorecard
- Draw a Dinosaur Drawing Sheet
- How to Draw a Dinosaur Instruction Sheet
  - Parasaurolophuis
  - Dimetrodon
  - Stegosaurus
  - Tyrannosaurus
  - Spinosaurus
  - Apatosaurus

ALL THAT DINO JAZZ™

© 1996 Amy Hertel

RULES OF THE GAME

FIG 9

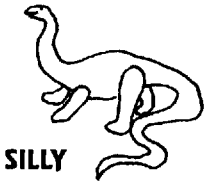

SILLY

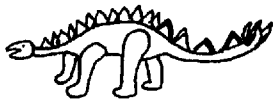

STEG

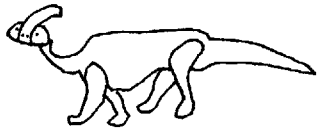

PAIRS

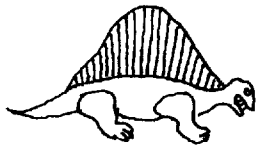

TEN CENTS

For 2 to 6 players/Ages 10 to adult

Object: To survive the tarpit

Choose Marker: Players must know the type of dinosaur marker he/she is using. A herbivore or carnivore.

Choose First Player: Player with first birthday is first. Player with second birthday is second and so on.

How Die Work: Each player chooses one set of die. One set consists of 4 dice. Player throws the die down and each red die that comes up, move that number of squares.

ex. 1 red - 3 blue move one square
2 red - 2 blue move two squares
3 red - 1 blue move three squares
4 red - 0 blue move four squares

LANDING IN SQUARES

Draw a Dinosaur: Player picks a dinosaur to draw. Each time the player lands on this square, more of the dinosaur is drawn. (See instructions on How to Draw A Dinosaur). A complete dinosaur should be done by the end of the game. A time limit of 60 seconds is imposed on the player to draw each part.

Answer a Dinosaur Question: The adult draws a card for the player who has landed on the square and reads the Question. If answered correctly, the player earns an energy bar and circles his/her scorecard.

Define a Dinosaur Word: The adult draws a card for the player who has landed on the square and reads the word to be Defined. If answered correctly, the player earns an energy bar and circles his/her scorecard.

Pronounce a Dinosaur Name: The adult shows the card to the player who has landed on the square. The name of the Dinosaur must be Pronounced correctly. If pronounced correctly, the player earns an energy bar and circles his/her scorecard.

Spell a Dinosaur Word: The adult reads the word for the player who has landed on the square. The player must Spell the word correctly. If spelled correctly, the player earns an energy bar and circles his/her scorecard.

Go to the Tarpit: When a player lands on this square, he/she must move into the tarpit and miss a turn.

To get out of the Tarpit: A player can turn in 2 energy bars to the adult at the time they entered the tarpit; or, the player can wait and miss one turn. To move out of the tarpit, the player places his/her marker on the matching dinosaur (Carnivore or Herbivore) where marked on the game board "Move Marker Here".

Go to China for Dig: When a player lands on this square, they lose a turn due to time in travelling to China and time spent on the dig in China.

Amy's Museum of Killer Death Lizards When a player lands on this square, they lose a turn due to being elected the curator of the museum.

If you are a Herbivore, Go back one Space: If a player's marker is a Herbivore, move back one space because you, the herbivore, was just attacked by a carnivore.

If you are a Carnivore, Go ahead one Space: If a player's marker is a Carnivore, go ahead one space because you, the carnivore, attacked the Herbivore.

Scorecard Use: Each player receives a scorecard before game begins. As each square is landed on and questions answered, it is the responsiblity of the player to circle each YES or NO for each round. There are seven rounds in one game. There are fourteen chances to answer questions, pronounce names, spell words, define words, and draw a dinosaur. Rounds change when players go past start.

Winning the Games: All play is stopped when the first person completes all seven rounds. If there is a tie, the person with the most energy bars wins. If there is still a tie, the player with the best looking drawn dinosaur wins.

SPINY

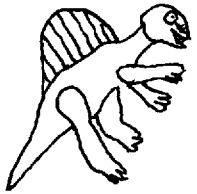

T.J.

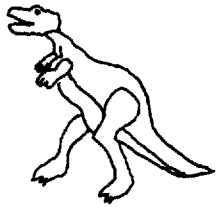

FIG 10

HOW TO DRAW A DINOSAUR INSTRUCTION SHEET
PARASAUROLOPHUS (PAIRS)

1. DRAW BODY FIRST.
2. DRAW UPPER NECK, HEAD, AND UPPER TAIL.
3. DRAW LOWER NECK, LEG BEGINNINGS, AND LOWER TAIL.
4. FINISH LEGS AND ANY MISCELLANEOUS BODY PARTS.
5. DRAW CLAWS, EYES, NOSTRILS, AND TEETH.
6. ERASE EXCESS LINES.
7. COLOR.
8. DRAW BACKGROUND SCENERY.

ALL THAT DINO JAZZ™ © 1996 Amy Hertel

HOW TO DRAW A DINOSAUR INSTRUCTION SHEET
DIMETRODON (TEN CENTS)

1. DRAW BODY FIRST.
2. DRAW UPPER NECK, HEAD, AND UPPER TAIL.
3. DRAW LOWER NECK, LEG BEGINNINGS, AND LOWER TAIL.
4. FINISH LEGS AND ANY MISCELLANEOUS BODY PARTS.
5. DRAW CLAWS, EYES, NOSTRILS, AND TEETH.
6. ERASE EXCESS LINES.
7. COLOR.
8. DRAW BACKGROUND SCENERY.

ALL THAT DINO JAZZ™ © 1996 Amy Hertel

HOW TO DRAW A DINOSAUR INSTRUCTION SHEET
STEGOSAURUS (STEG)

1. DRAW BODY FIRST.
2. DRAW UPPER NECK, HEAD, AND UPPER TAIL.
3. DRAW LOWER NECK, LEG BEGINNINGS, AND LOWER TAIL.
4. FINISH LEGS AND ANY MISCELLANEOUS BODY PARTS.
5. DRAW CLAWS, EYES, NOSTRILS, AND TEETH.
6. ERASE EXCESS LINES.
7. COLOR.
8. DRAW BACKGROUND SCENERY.

ALL THAT DINO JAZZ™ © 1996 Amy Hertel

HOW TO DRAW A DINOSAUR INSTRUCTION SHEET
TYRANNOSAURUS (T.J.)

1. DRAW BODY FIRST.
2. DRAW UPPER NECK, HEAD, AND UPPER TAIL.
3. DRAW LOWER NECK, LEG BEGINNINGS, AND LOWER TAIL.
4. FINISH LEGS AND ANY MISCELLANEOUS BODY PARTS.
5. DRAW CLAWS, EYES, NOSTRILS, AND TEETH.
6. ERASE EXCESS LINES.
7. COLOR.
8. DRAW BACKGROUND SCENERY.

ALL THAT DINO JAZZ™ © 1996 Amy Hertel

HOW TO DRAW A DINOSAUR INSTRUCTION SHEET
SPINOSAURUS (SPINY)

1. DRAW BODY FIRST.
2. DRAW UPPER NECK, HEAD, AND UPPER TAIL.
3. DRAW LOWER NECK, LEG BEGINNINGS, AND LOWER TAIL.
4. FINISH LEGS AND ANY MISCELLANEOUS BODY PARTS.
5. DRAW CLAWS, EYES, NOSTRILS, AND TEETH.
6. ERASE EXCESS LINES.
7. COLOR.
8. DRAW BACKGROUND SCENERY.

ALL THAT DINO JAZZ™ © 1996 Amy Hertel

HOW TO DRAW A DINOSAUR INSTRUCTION SHEET
APATOSAURUS (SILLY)

1. DRAW BODY FIRST.
2. DRAW UPPER NECK, HEAD, AND UPPER TAIL.
3. DRAW LOWER NECK, LEG BEGINNINGS, AND LOWER TAIL.
4. FINISH LEGS AND ANY MISCELLANEOUS BODY PARTS.
5. DRAW CLAWS, EYES, NOSTRILS, AND TEETH.
6. ERASE EXCESS LINES.
7. COLOR.
8. DRAW BACKGROUND SCENERY.

ALL THAT DINO JAZZ™ © 1996 Amy Hertel

EDUCATIONAL DINOSAUR BOARD GAME

BRIEF SUMMARY OF THE INVENTION

The present invention relates to children's games and, more particularly, to a new, innovative, and educational way to learn about dinosaurs and a way for children to creatively express their artistic abilities by drawing dinosaurs within the play of the game.

The object of this invention is to teach children, in a fun way, about dinosaurs. There is no strategy to this game. A player can't kick another player off a square or send a player "back home". All players go at their own pace. The pace is set by how well the individual answers questions about dinosaurs, how well names of dinosaurs are pronounced, how well dinosaur words are spelled, and how well dinosaur words are defined. Drawing a dinosaur during the game gives the children a break from answering questions, defining dinosaur words, spelling dinosaur words, and pronouncing dinosaur names. Drawing makes the game fun and exciting.

BRIEF DESCRIPTION OF THE DRAWINGS

The drawings illustrate the best mode presently contemplated of carrying out the invention.

In the drawings:

FIG. 3 is a view illustrating the scorecard. There are four columns with a heading for each column: Pronounce, Spell, and Define, Answer. Also, there are seven rounds to each game with a yes or no to be circled for correct/incorrect answers;

FIG. 9 is a view that illustrates the front and back cover of the Rules of the Game to be used and referred to during play;

FIG. 10 is a view that illustrates the inside portion of the Rules of the Game of FIG. 9. The rules explain how the game is played and to answer any questions about how to play the game;

DETAILED DESCRIPTION OF THE INVENTION

Figure 1:
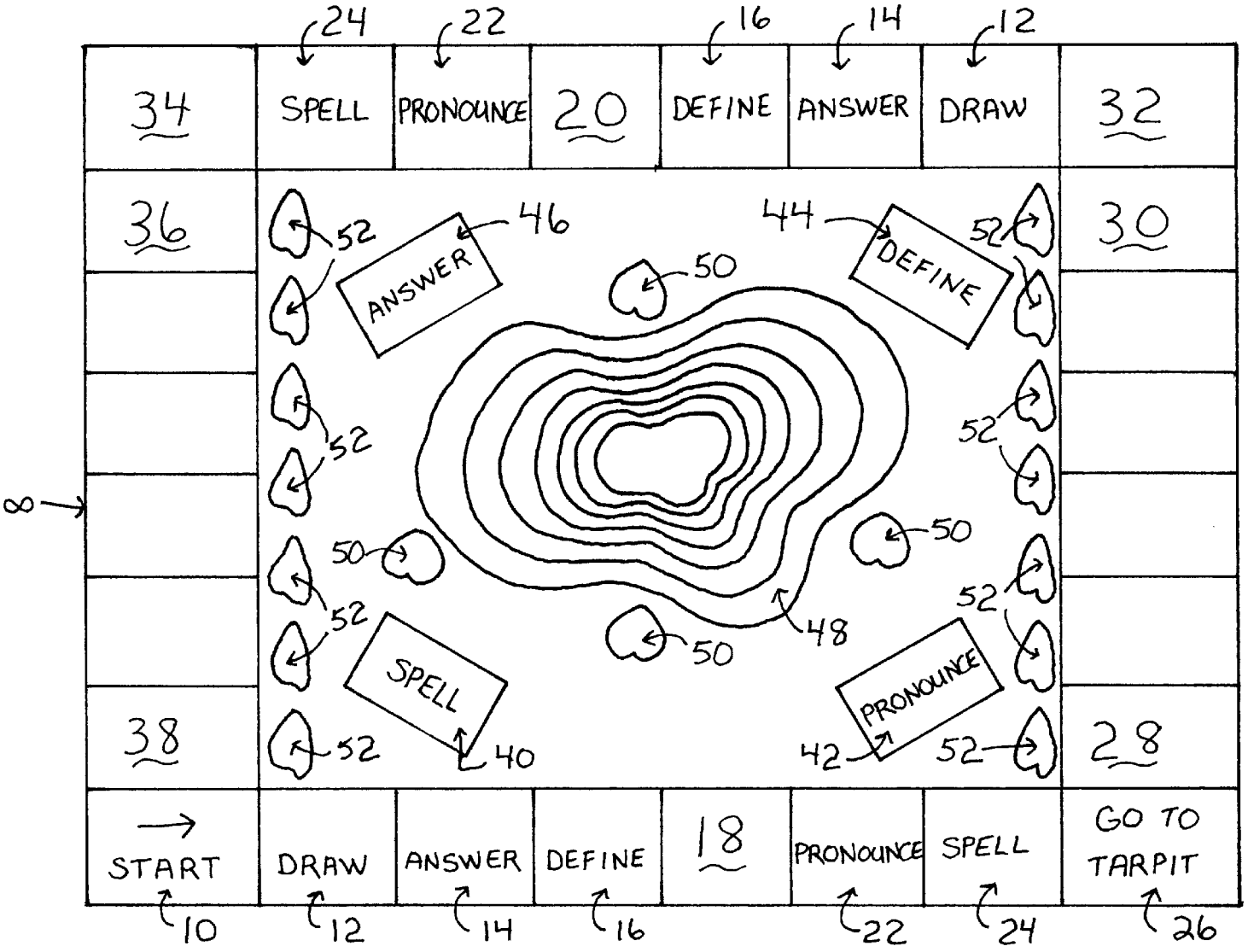
FIG. 1 is a view illustrating the various components of the game apparatus of the invention, including the game board, the tarpit, placement of the four decks of cards, and the trees and bushes.

FIG. 1 generally illustrates the components of the game board apparatus of the invention, which include a game board 8, the tarpit 48, the four decks of cards: Spell a Dinosaur Word 40, Pronounce a Dinosaur Name 42, Define a Dinosaur Word 44, Answer a Dinosaur Question 46, the trees 50, and the bushes 52.

As shown in FIG. 1, game board 8, includes a series of spaces with movement of the game in a counterclockwise direction. The spaces are labeled with directions. The spaces follow a horizontal and vertical pattern on the game board 8. Start 10, located in the bottom left-hand corner is where the game begins, following a horizontal movement, counterclockwise, to the right, requires player action 12, 14, 16, 18, 22, 24. The bottom right-hand corner is the Go To Tarpit 26. Vertical movement requires no action by the player, as play moves up to the next corner space, which is the top right-hand corner space Go To China For Dig 32. Again, horizontal movement, counterclockwise, to the left, requires player action 12, 14, 16, 20, 22, 24. As play moves to the next corner space which is the top left-hand corner space Amy's Museum of Killer Death Lizards 34. Play then proceeds in a downward fashion back towards Start 10.

Referring to FIG. 1 the game board 8, the tarpit 48 is located in the center of the board game 8, and is multicolored (black, tan, and green) shape. When player is able to leave the tarpit 48, player will either place the marker in the space 28, 30 depending on what type of dinosaur marker the player is using—Herbivore or Carnivore.

Referring to FIG. 1 the game board 8 it further contains individual places for each set of decks of cards. Spell a Dinosaur Word 40, located in lower left-hand corner. Pronounce a Dinosaur Name 42, located in lower right-hand corner. Define a Dinosaur Word 44, located in the upper right-hand corner. Answer a Dinosaur Question 46, located in the upper left-hand corner.

Referring to FIG. 1 game board 8 includes trees 50 and bushes 52 for decorative purposes only.

Figure 2:
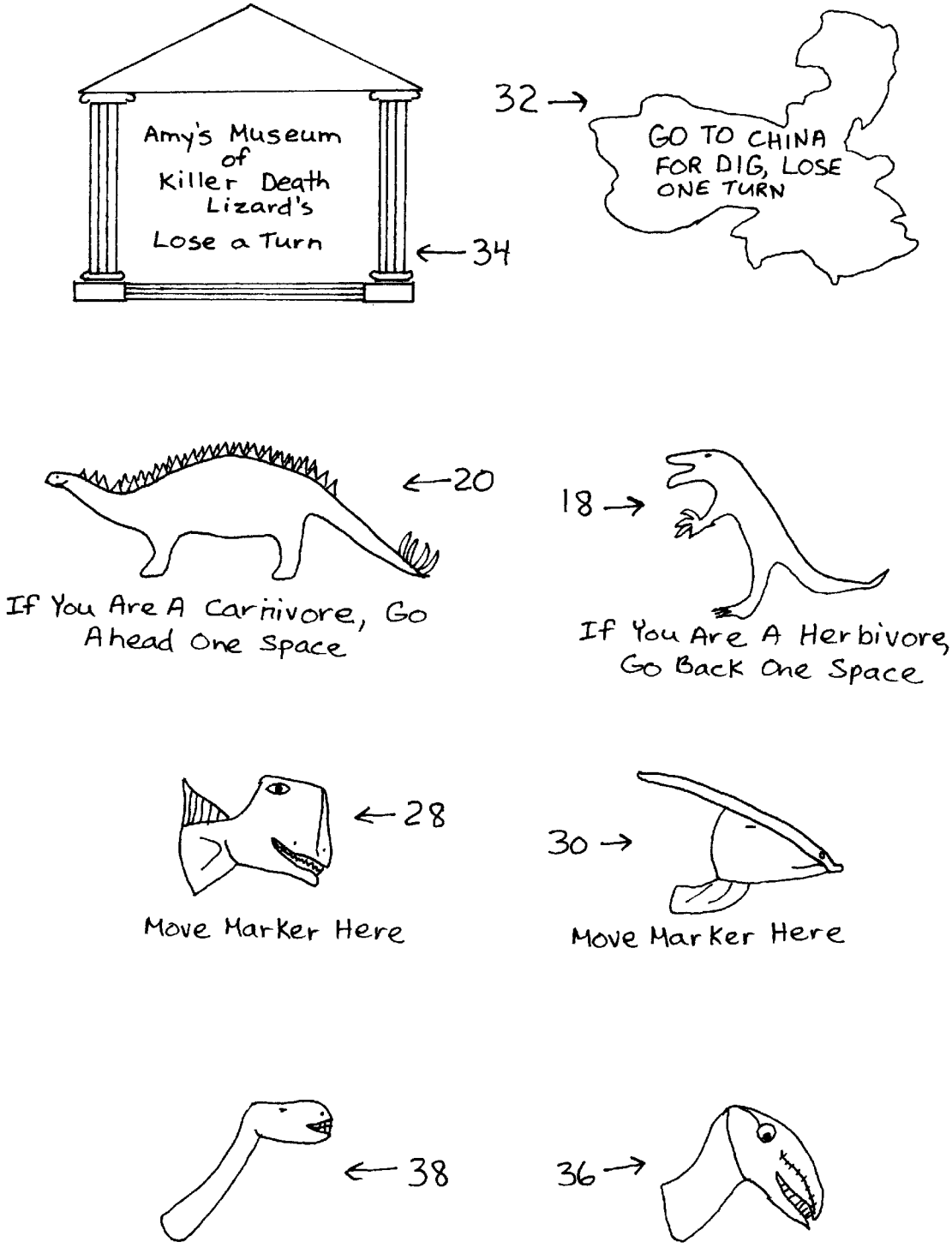
FIG. 2 is an exploded view of individual spaces in greater detail.

FIG. 2 is an exploded view of 2 corner squares 34, 32 located on game board 8, 2 action squares 20, 18 located on game board 8, 2 Move Marker Here squares 28, 30 located on game board 8, and 2 individual squares for decorative purposes only 38, 36 located on game board 8. This view shows greater detail.

FIG. 3 depicts representative illustrations that are provided on the surface of the Scorecard. Each player receives a scorecard before game begins. Players are responsible for marking their scorecard. If player correctly/incorrectly answers a question, defines a word, spells a word, pronounces a name, then player circles Yes or No. There are seven rounds to one game with a total of fourteen chances to correctly answer, spell, define, or pronounce. Rounds change when players go past Start 10.

Figure 4:
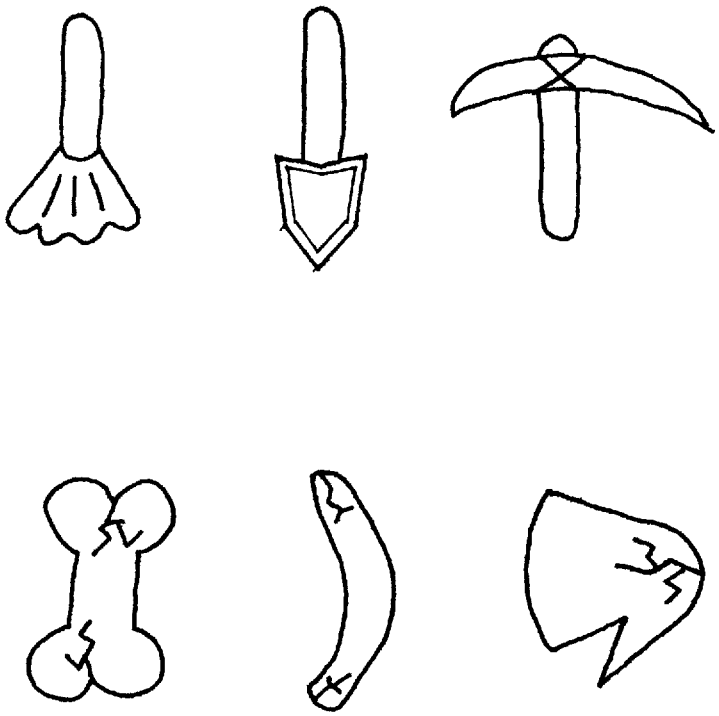
FIG. 4 is a view illustrating the die. There are six types of die: the brush, the shovel, the pick ax, the bone, the rib bone, and the claw. Each set of die contains four dice. The die is red on one side and blue on the opposite side.

FIG. 4 depicts representative illustrations of the die. There are six different types of die, which represent shapes of archaeological digging tools and dinosaur bones. There are three types of digging tools: a brush, a shovel, and a pick ax. There are three types of dinosaur bones: a bone, a rib bone, and a claw. Players choose which type of die to use during the game before play begins. Each dice is red on one side and blue on the other side. The die are cut to the shapes of a brush, shovel, pick as, bone, rib bone, and claw using red and blue construction paper and laminating the pieces together. Players use the die according to the Rules of the Game 9, 10.

Figure 5:
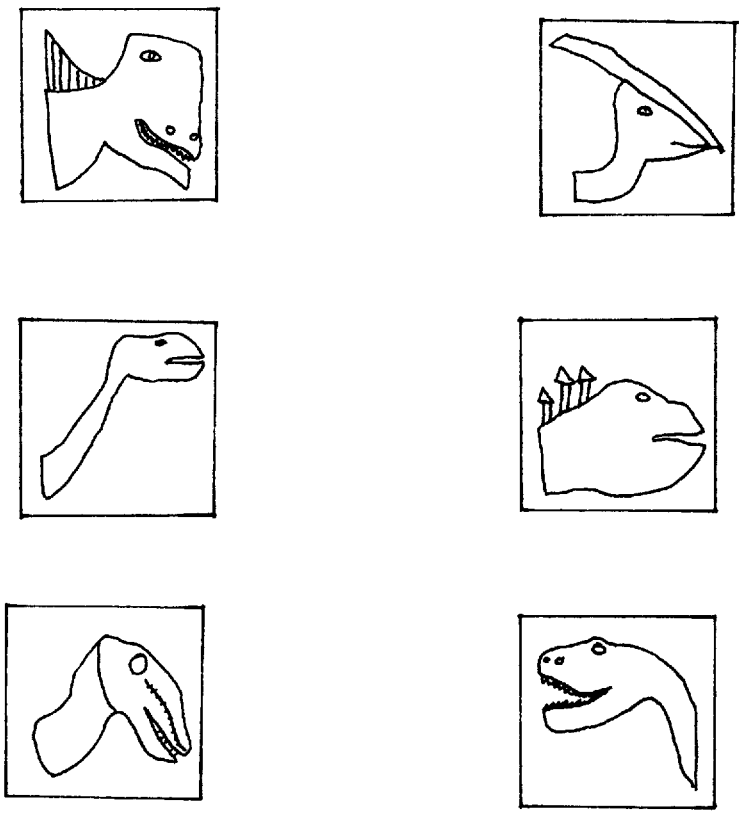
FIG. 5 is a view illustrating the markers. There are six different dinosaur markers. There are three carnivore dinosaurs and three herbivore dinosaurs. Players must know the type of dinosaur used during the game a carnivore or herbivore.

FIG. 5 depicts representative illustration of the markers. The illustrations on the markers represent six different types of dinosaurs. There are three herbivore dinosaurs and three carnivore dinosaurs. The markers are 1½ inches in length and 1½ inches in width. The illustrations of the dinosaurs are on the front and the name of the game is on the back. The markers are laminated to stay together. Players use the markers according to the Rules of the Game 9, 10.

Figure 6:
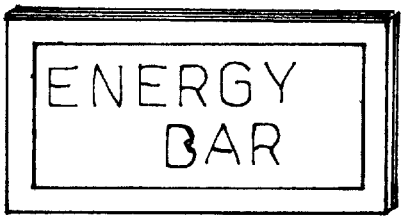
FIG. 6 is a view illustrating the energy bars. An energy bar is earned by correctly answering a dinosaur question, defining a dinosaur word, spelling a dinosaur word, and pronouncing a dinosaur name. The energy bars are bonus points that help players get out of the tarpit and to break ties at the end of the game.

FIG. 6 depicts representative illustrations of the Energy Bars. The energy bars are made from red construction paper. Players use the energy bars according to the Rules of the Game 9, 10.

Figure 7:
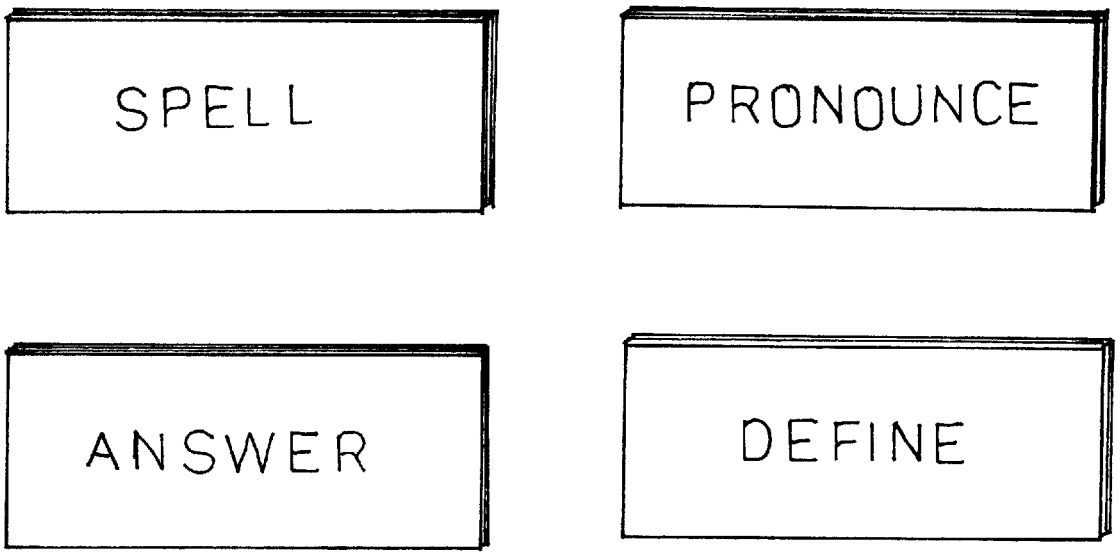
FIG. 7 is a view illustrating the question, spell, define, pronounce cards appear as and used during play. There are four decks of cards: Question, Spell, Define, and Pronounce. There are forty-two different types of questions, spelling and defining words, and dinosaur names to pronounce.

FIG. 7 depicts representative illustrations of the card. FIG. 7 can be divided into four categories that are Pronounce, Spell, Define, and Question. Each card requests that an answer be given in order to move forward on the game board 8. When squares 14, 16, 22, and 24 are landed on during play, players pick a card from the four card piles on the game board according to the square landed on. Correctly answering a card will give the player an energy bar 6. Players use the cards according to the Rules of the Game 9, 10.

Figure 8:
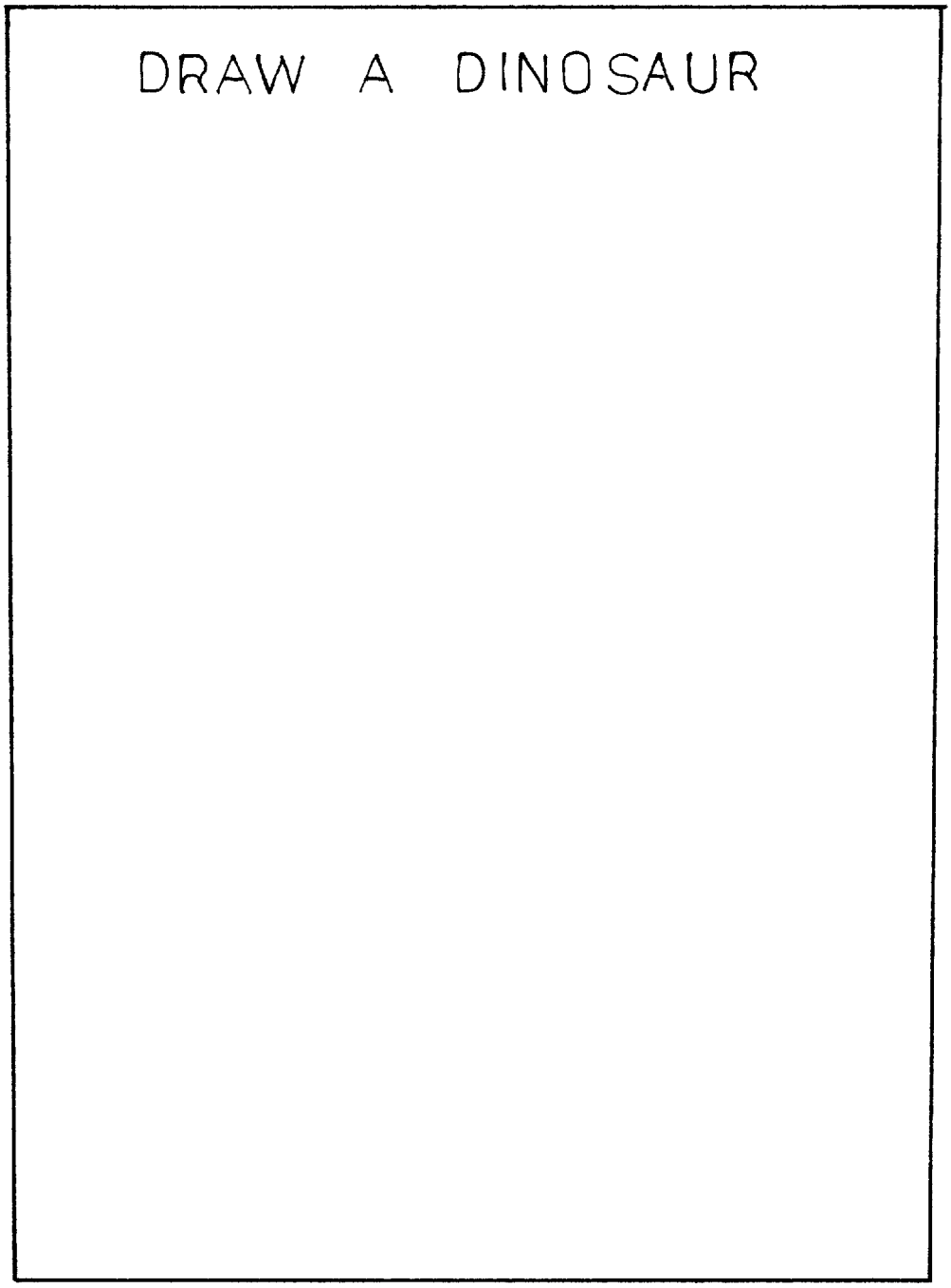
FIG. 8 is a view illustrating the Draw A Dinosaur drawing sheet. The sheet is 8½×11 piece of paper and used by the players to draw the dinosaur picked at the beginning of the game.

FIG. 8 depicts representative illustration of the Draw A Dinosaur drawing sheet. The player picks a drawing sheet before play begins so the player can draw a dinosaur when the square Draw a Dinosaur 12, is landed on during the game. Players use the drawing sheet according to the Rules of the Game 9, 10.

FIG. 9 depicts representative illustration of the Rules of the Game. FIG. 9 illustrates the front and back cover. The back cover lists the contents that are used for play of the game. The front cover shows the title of the game and describes that this is the Rules of the Game. The paper is folded in half, vertically, on the left side so that the front cover is on the front and the back cover is on the backside.

FIG. 10 depicts representative illustration of the Rules of the Game. FIG. 10 illustrates the inside portion of the rules. The rules are listed in four columns with drawings of each dinosaur on the top of the page and down the right hand side of the page.

Figure 11:
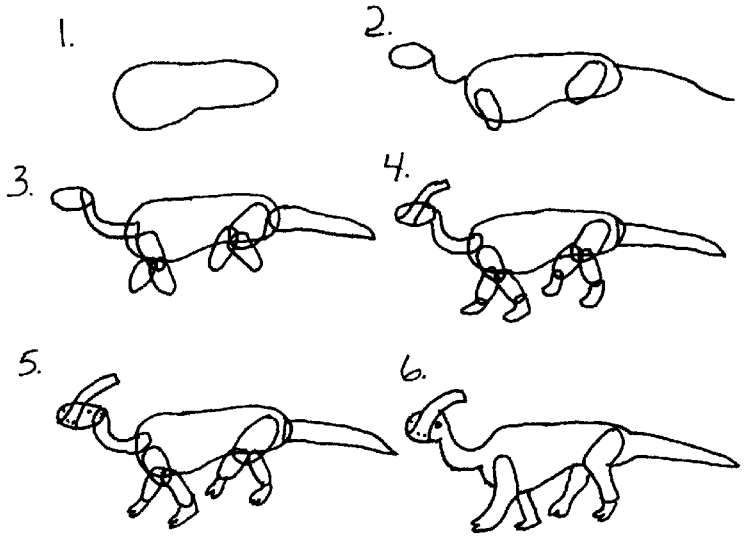
FIG. 11 is a view illustrating the instruction sheet and explains how to draw the dinosaur-Parasaurolophus. There are six steps used by each player to draw a dinosaur using FIG. 8. The instruction sheet tells the player how to draw each step as each draw a dinosaur square is landed on the game board of FIG. 1.

FIG. 11 depicts representative illustration of the How to Draw A Dinosaur Instruction Sheet for the Parasaurolophus dinosaur. When square Draw a Dinosaur 12 is landed on, the player to start drawing a dinosaur using the FIG. 8 drawing sheet consults FIG. 11. An instruction sheet is provided for each dinosaur with instructions to draw the dinosaur. Dinosaur Instruction Sheets are picked at random by players to draw during the game.

Figure 12:
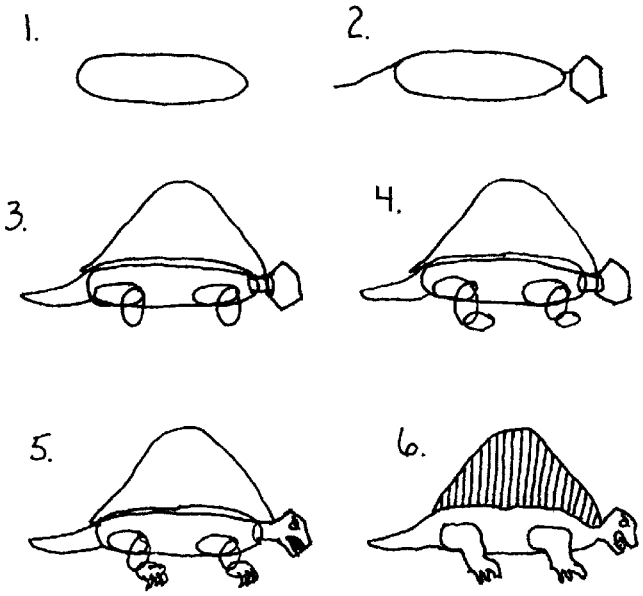
FIG. 12 is a view illustrating the instruction sheet and explains how to draw the dinosaur-Dimetrodon. There are six steps that are used by each player to draw a dinosaur using FIG. 8. The instruction sheet tells the player how to draw each step as each draw a dinosaur square is landed on the game board of FIG. 1.

FIG. 12 depicts representative illustration of the How to Draw A Dinosaur Instruction Sheet for the Dimetrodon dinosaur. When square Draw a Dinosaur 12 is landed on, the player to start drawing a dinosaur using the FIG. 8 drawing sheet consults FIG. 12. An instruction sheet is provided for each dinosaur with instructions to draw the dinosaur. Dinosaur Instruction Sheets are picked at random by players to draw during the game.

Figure 13:
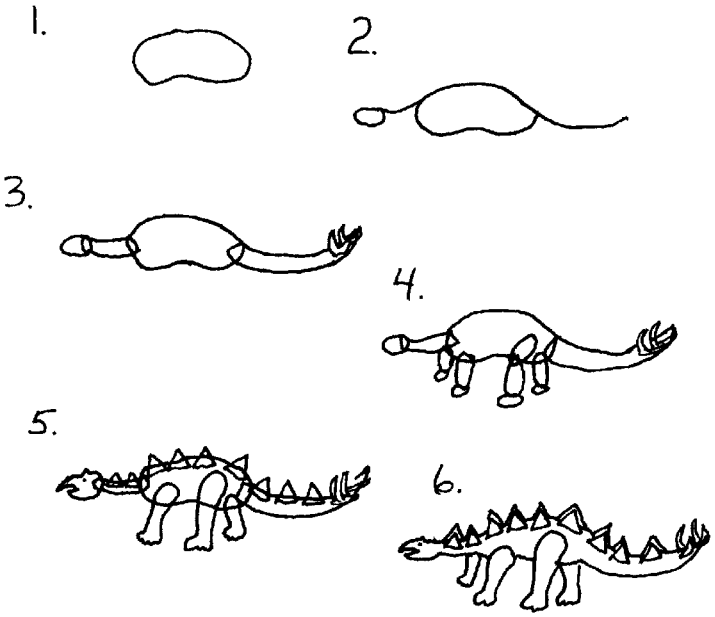
FIG. 13 is a view illustrating the instruction sheet and explains how to draw the dinosaur-Stegosaurus. There are six steps that are used by each player to draw a dinosaur using FIG. 8. The instruction sheet tells the player how to draw each step as each draw a dinosaur square is landed on the game board of FIG. 1.

FIG. 13 depicts representative illustration of the How to Draw A Dinosaur Instruction Sheet for the Stegosaurus dinosaur. When square Draw a Dinosaur 12 is landed on, the player to start drawing a dinosaur using the FIG. 8 drawing sheet consults FIG. 1. An instruction sheet is provided for each dinosaur with instructions to draw the dinosaur. Dinosaur Instruction Sheets are picked at random by players to draw during the game.

Figure 14:
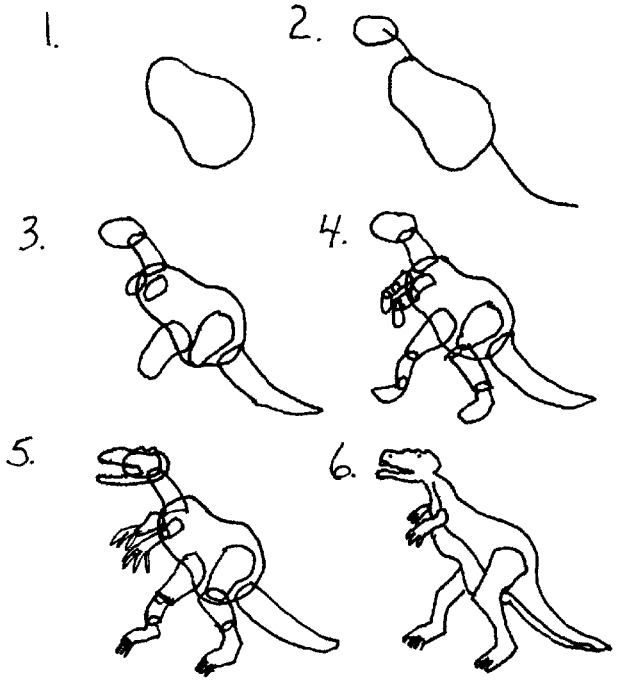
FIG. 14 is a view illustrating the instruction sheet and explains how to draw the dinosaur-Tyrannosaurus. There are six steps that are used by each player to draw a dinosaur using FIG. 8. The instruction sheet tells the player how to draw each step as each draw a dinosaur square is landed on the game board of FIG. 1.

FIG. 14 depicts representative illustration of the How to Draw A Dinosaur Instruction Sheet for the Tyrannosaurus dinosaur. When square Draw a Dinosaur 12 is landed on, the player to start drawing a dinosaur using the FIG. 8 drawing sheet consults FIG. 14. An instruction sheet is provided for each dinosaur with instructions to draw the dinosaur. Dinosaur Instruction Sheets are picked at random by players to draw during the game.

Figure 15:
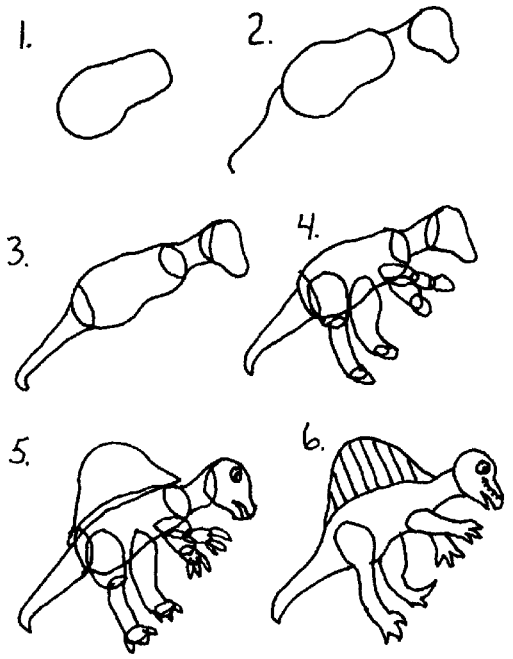
FIG. 15 is a view illustrating the instruction sheet that explains how to draw the dinosaur-Spinosaurus. There are six steps that are used by each player to draw a dinosaur using FIG. 8. The instruction sheet tells the player how to draw each step as each draw a dinosaur square is landed on the game board of FIG. 1.

FIG. 15 depicts representative illustration of the How to Draw A Dinosaur Instruction Sheet for the Spinosaurus dinosaur. When square Draw a Dinosaur 12 is landed on, the player to start drawing a dinosaur using the FIG. 8 drawing sheet consults FIG. 15. An instruction sheet is provided for each dinosaur with instructions to draw the dinosaur. Dinosaur Instruction Sheets are picked at random by players to draw during the game.

Figure 16:
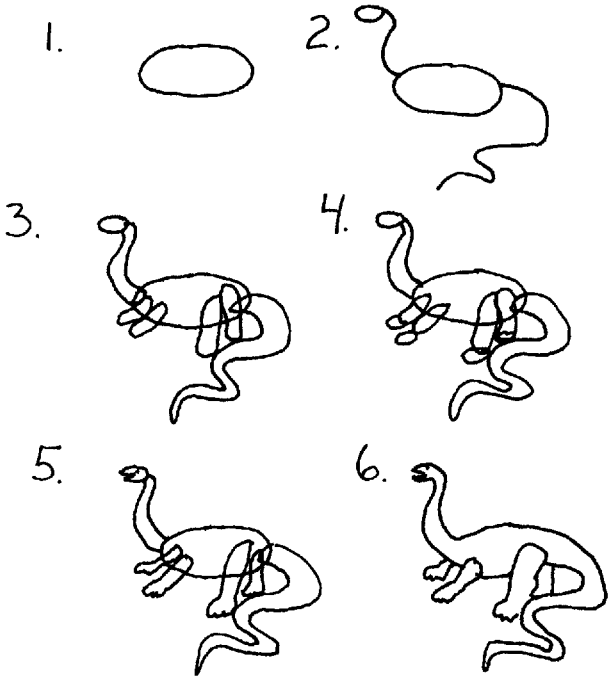
FIG. 16 is a view illustrating the instruction sheet that explains how to draw the dinosaur-Apatosaurus. There are six steps that are used by each player to draw a dinosaur using FIG. 8. The instruction sheet tells the player how to draw each step as each draw a dinosaur square is landed on the game board of FIG. 1.

FIG. 16 depicts representative illustration of the How to Draw A Dinosaur Instruction Sheet for the Apatosaurus dinosaur. When square Draw a Dinosaur 12 is landed on, the player to start drawing a dinosaur using the FIG. 8 drawing sheet consults FIG. 16. An instruction sheet is provided for each dinosaur with instructions to draw the dinosaur. Dinosaur Instruction Sheets are picked at random by players to draw during the game.

The rules in play of the game apparatus illustrated in FIG. 9–10 will now be explained.

Object

The object of the game of the invention is to be the first player to survive the tarpit by completing the seven rounds of the game by moving the marker in a counterclockwise direction and correctly answering the four decks of cards.

Setup

Prior to commencing play, each player picks a number of things to use during the game. Player pick the markers, the dice, the Draw a Dinosaur Drawing Sheet, the How to Draw A Dinosaur Instruction Sheet, and a Scorecard. The Energy Bars are left in a pile next to the game board waiting for players to earn them. The four decks of cards are shuffled and put in the proper place to be picked as needed.

Playing the Game

The player with the first birthday (beginning Jan to Dec) goes first then player with second birthday is second and so on. Player chooses a Marker FIG. 5 and players place their markers on the game board 8, Start square 10. The first player to go throws the die down on a smooth surface and count up the required number of moves according to the Rules of the Game FIG. 10. When player moves and lands in each square, draw a dinosaur 12, player must then begin to draw a dinosaur using the Drawing Sheet FIG. 8 and How to Draw a Dinosaur Instruction Sheet FIG. 11–16. If a Player lands on an answer a dinosaur question square 14 player picks a question card from the deck 46 on the game board 8. If a player lands on define a dinosaur word square 16 player picks a define card from the deck 44 on the game board 8. If a player lands on a pronounce a dinosaur name square 22 player picks a pronounce card from the deck 42 on the game board 8. If a player lands on a spell a dinosaur word square 24 player picks a spell card from the deck 40 on the game board 8. If a player answers a dinosaur question, defines a dinosaur word, spells a dinosaur word, or pronounces a dinosaur name correctly player will circle Yes on the scorecard and receive one energy bar from the pile. If player answers incorrectly, player circles No and does not receive any energy bars from the pile. If player lands on if you are a herbivore, go back one space 18, player must know which type of dinosaur marker is being used to decide that square. If the player has a carnivore marker, player remains in place. If the player has a herbivore marker, player goes back one space. If player lands in the Go to Tarpit Square 26, player must place the marker in the center of the tarpit 48 located on the game board 8. Player can use two energy bars FIG. 6 to get out of the tarpit right away or lose a turn. If player chooses to use two energy bars, then player places marker on squares 28 or 30 depending on what type of dinosaur player's marker is. If player lands in Go to China for Dig Square 32, player loses one turn. Energy bars cannot be used for this square. If player lands in if you are a carnivore, go ahead one Space Square 20 on the game board 8, player must know what type of dinosaur marker is being used to decide this square. If player is a carnivore, player moves the marker one space ahead. If player is a herbivore, player remains on the square. If player lands on Amy's Museum of Killer Death Lizards square 34 player loses one turn. Energy bars cannot be used for this square. If player lands on square 38 or 36 nothing happens. When player passes Start 10 seven times, player is determined to be the winner. If there should be a tie, player with the most energy bars will win. If there is still a tie, player with the best-drawn dinosaur wins the game.

I claim:

1. A method of playing an educational dinosaur board game, comprising the steps of:

providing a game set including, a game board having a set number of individual spaces with instructions and a tarpit area;

a set number of cards for each of four types of instructions which include, Answer a Dinosaur Question, Spell a Dinosaur Word, Pronounce a Dinosaur Name, and Define a Dinosaur Word;

a scorecard that includes seven rounds with four columns of YES or NO for the types of instruction cards which include, Pronounce, Spell, Define, Answer;

a set of dice which include six different types of indicia which are the brush, the shovel, the pick ax, the bone, the rib bone, and the claw;

a marker which represents a type of dinosaur, carnivore or herbivore;

a set number of Energy Bars that are used as bonus points for answering the instruction cards correctly;

a pad of drawing paper called DRAW A DINOSAUR that each player must use during the game to draw a dinosaur;

a copy of the Rules of the Game, so the game will be correctly played;

an instruction sheet for drawing each dinosaur which includes: the Parasaurolophus, the Dimetrodon, the Stegosaurus, the Tyrannosaurus, the Spinosaurus, and the Apatosaurus;

utilizing the die to advance a player around the board game seven rounds in a counterclockwise direction;

utilizing the instruction cards which include: Answer a Dinosaur Question, Spell a Dinosaur Word, Define a Dinosaur Word, and Pronounce a Dinosaur Name along with the die to control the progress of the player during the movement around the board game seven rounds.

2. The method of claim 1, wherein during the game players are drawing a dinosaur according to an instruction sheet and that at the end of the game if a tie happens, the best drawn dinosaur wins.

* * * * *